US011553273B2

(12) United States Patent
Wang et al.

(10) Patent No.: US 11,553,273 B2
(45) Date of Patent: Jan. 10, 2023

(54) PASSIVE DIAPHRAGM ASSEMBLY

(71) Applicant: Jabil Circuit (Singapore) Pte. Ltd., Singapore (SG)

(72) Inventors: Wen Hong Wang, Taichung (TW); Ching Feng Lin, Taichung (TW); Chia Chien Chen, Taichung (TW); Po-Cheng Huang, Taichung (TW); Shih-Hsien Yang, Taichung (TW)

(73) Assignee: Jabil Circuit (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/475,442

(22) Filed: Sep. 15, 2021

(65) Prior Publication Data

US 2022/0141574 A1 May 5, 2022

(30) Foreign Application Priority Data

Nov. 2, 2020 (CN) ..... 202022498374.4

(51) Int. Cl.
*H04R 1/28* (2006.01)
*H04R 9/06* (2006.01)

(52) U.S. Cl.
CPC ..... *H04R 1/2834* (2013.01); *H04R 9/06* (2013.01); *H04R 2307/207* (2013.01)

(58) Field of Classification Search
CPC .. H04R 1/2834; H04R 9/06; H04R 2307/207; H04R 1/02; H04R 1/24; H04R 7/122; H04R 2499/11; H04R 7/20; H04R 7/04; H04R 2207/021; H04R 1/2826; H04R 1/227; H04R 1/2857; H04R 2205/021; H04R 1/2819; H04R 1/345; H04R 1/26; H04R 1/2873; H04R 1/288; H04R 7/26
See application file for complete search history.

(56) References Cited

U.S. PATENT DOCUMENTS

| | | | | |
|---|---|---|---|---|
| 4,301,332 | A * | 11/1981 | Dusanek | H04R 1/2834 381/349 |
| 6,782,112 | B1 * | 8/2004 | Geddes | H04R 1/2834 381/345 |
| 9,402,126 | B2 | 7/2016 | Yeh | |
| 9,961,449 | B2 | 5/2018 | Honda et al. | |
| 10,349,166 | B2 * | 7/2019 | Sahyoun | H04R 1/2826 |
| 10,484,788 | B1 * | 11/2019 | Kudekar | H04R 1/2834 |
| 2006/0078136 | A1 * | 4/2006 | Stiles | H04R 1/345 381/345 |
| 2006/0078144 | A1 * | 4/2006 | Stiles | H04R 1/345 381/87 |
| 2015/0304760 | A1 * | 10/2015 | Yeh | H04R 1/1058 381/370 |

FOREIGN PATENT DOCUMENTS

| | | | | |
|---|---|---|---|---|
| CN | 110708642 | A * | 1/2020 | H04R 9/02 |

* cited by examiner

*Primary Examiner* — Angelica M McKinney
(74) *Attorney, Agent, or Firm* — Young Basile Hanlon & MacFarlane, P.C.

(57) ABSTRACT

A passive diaphragm assembly includes a counterweight member, a first diaphragm and a second diaphragm. The first diaphragm and the second diaphragm are spaced apart from each other, are connected respectively to opposite ends of the counterweight member, and cooperate with the counterweight member to define an air space thereamong.

16 Claims, 2 Drawing Sheets

PASSIVE DIAPHRAGM ASSEMBLY

CROSS-REFERENCE TO RELATED APPLICATION

This application claims priority to Chinese Utility Model Patent Application No. 202022498374.4, filed on Nov. 2, 2020.

FIELD

The disclosure relates to a passive diaphragm assembly, and more particularly to a passive diaphragm assembly having two diaphragms.

BACKGROUND

A main driver and a conventional passive radiator that includes a diaphragm are generally disposed on a cabinet to cooperatively serve as a loudspeaker. The main driver, the conventional passive radiator and the cabinet cooperatively define an internal space thereamong. When the main driver generates sound waves, the sound waves cause increases and decreases in air pressure in the internal space. Then, in response to the air pressure changes in the internal space, the conventional passive radiator vibrates via the diaphragm to create sound. In the past, before the conventional passive radiator was known in the art, loudspeakers were required to have a large internal space in order to produce relatively high sound quality, especially for low-frequency sound, but since the conventional passive radiator has been adopted in loudspeakers, even a loudspeaker that has a relatively small internal space may create sound with relatively high sound quality.

However, due to a relatively thin thickness of the diaphragm, the conventional passive radiator may not vibrate in a desired direction, which brings a negative influence on overall audio performance of the conventional passive radiator.

SUMMARY

Therefore, an object of the disclosure is to provide a passive diaphragm assembly (i.e., a passive radiator) that can alleviate the drawback of the prior art.

According to the disclosure, the passive diaphragm assembly includes a counterweight member, a first diaphragm and a second diaphragm. The first diaphragm and the second diaphragm are spaced apart from each other, are connected respectively to opposite ends of the counterweight member, and cooperate with the counterweight member to define an air space thereamong.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
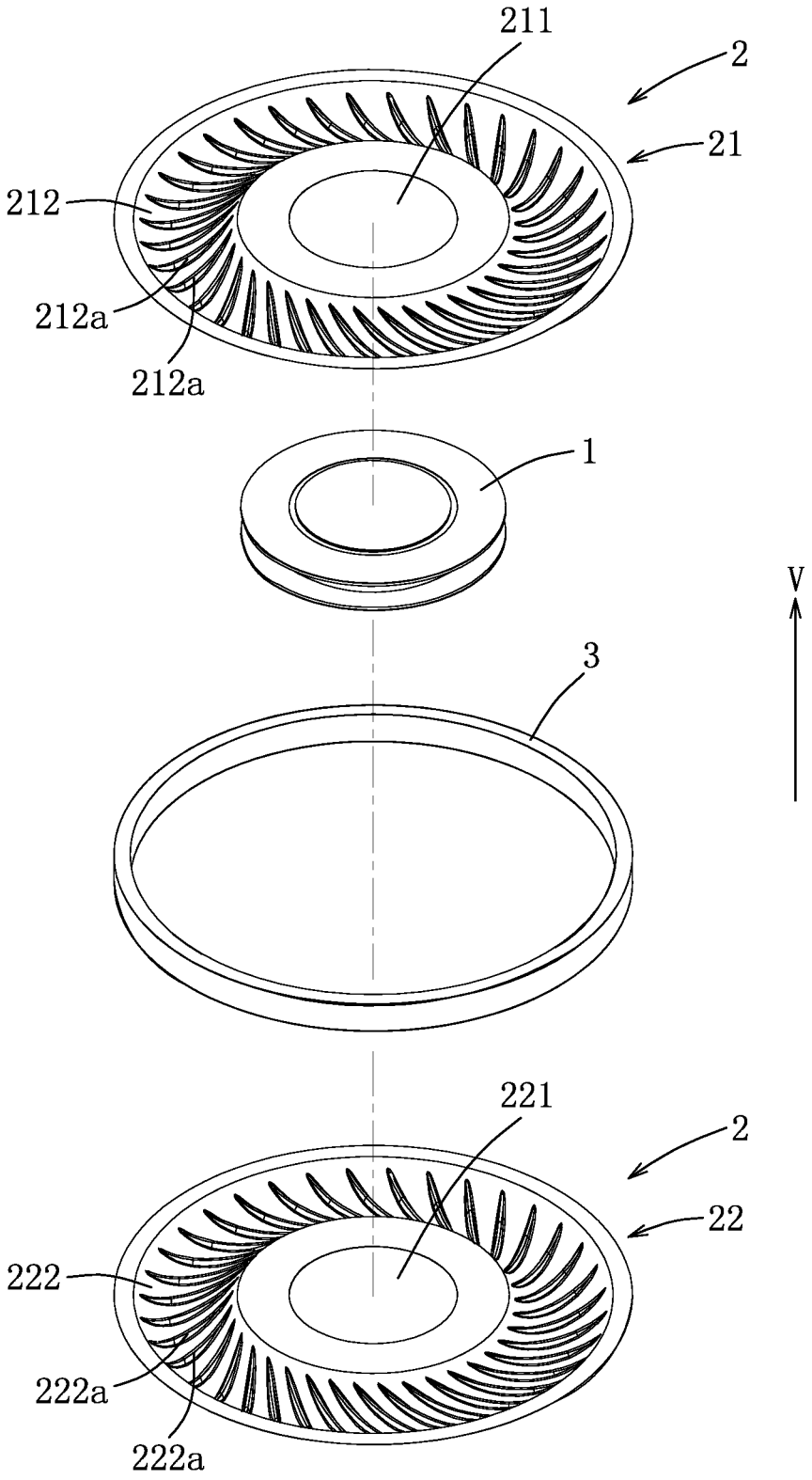
FIG. 1 is an exploded perspective view of an embodiment of a passive diaphragm assembly according to the disclosure.
Figure 2:
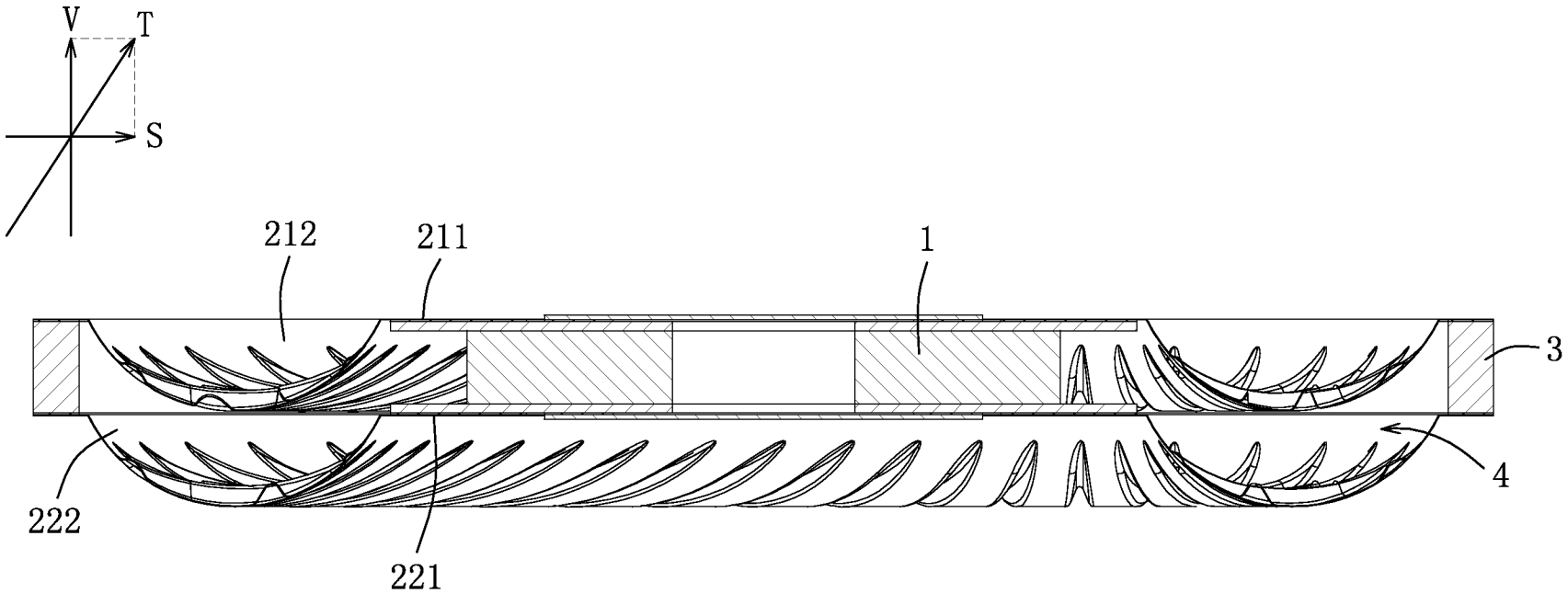
FIG. 2 is a sectional view of the embodiment.

Referring to FIGS. 1 and 2, an embodiment of a passive diaphragm assembly 100 according to the disclosure includes a counterweight member 1, a first diaphragm 21, a second diaphragm 22 and a surrounding member 3. In this embodiment, the counterweight member 1 is made of a metal material, and each of the first diaphragm 21 and the second diaphragm 22 is made of polyetheretherketone (PEEK) and is formed by a thermoforming process. However, the material that each of the counterweight member 1, the first diaphragm 21 and the second diaphragm 22 is made of is not limited to the abovementioned materials, and the manufacturing process by which each of the first diaphragm 21 and the second diaphragm 22 is formed is not limited to the thermoforming process.

The first diaphragm 21 and the second diaphragm 22 are spaced apart from each other, are connected respectively to opposite ends of the counterweight member 1 in a first direction (V), and cooperate with the counterweight member 1 to define an air space 4 thereamong. Each of the first diaphragm 21 and the second diaphragm 22 is circular plate-shaped, and has a central area 211, 221 and a surround 212, 222. For each of the first diaphragm 21 and the second diaphragm 22, the central area 211, 221 is connected to the counterweight 1, and the surround 212, 222 extends outwardly from the central area 211, 221. Specifically, the counterweight member 1 is clamped between the central areas 211, 221 of the first diaphragm 21 and the second diaphragm 22. Each of the first diaphragm 21 and the second diaphragm 22 has an arc-shaped cross section. The cross section of the second diaphragm 22 curves in a same direction as that of the first diaphragm 21. Specifically, the surround 212, 222 of each of the first diaphragm 21 and the second diaphragm 22 has the arc-shaped cross section when viewed in a direction perpendicular to the first direction (V). The cross section of the surround 222 of the second diaphragm 22 curves in the same direction as the cross section of the surround 212 of the first diaphragm 21 is curved. In this embodiment, a surface of the second diaphragm 22 which is opposite to the first diaphragm 21 is indented with at least one groove 222*a*, and a surface of the first diaphragm 21 which confronts the second diaphragm 22 is indented with at least one groove 212*a* communicating with the air space 4. In a modification of the present embodiment, a surface of the first diaphragm 21 which is opposite to the second diaphragm 22 may be indented with at least one groove, and a surface of the second diaphragm 22 which confronts the first diaphragm 21 may be indented with at least one groove communicating with the air space 4. Specifically, in this embodiment, the surround 212, 222 of each of the first diaphragm 21 and the second diaphragm 22 is indented with a plurality of the abovementioned grooves 212*a*, 222*a*. The grooves 212*a* are angularly spaced apart from each other, and so are the grooves 222*a*. The grooves 212*a*, 222*a* open in a same direction in which the cross section of the surround 212 of the first diaphragm curves. Each of the grooves 212*a* of the first diaphragm 21 extends in a direction different from a radial direction of the first diaphragm 21. Each of the grooves 222*a* of the second diaphragm 22 extends in a direction different from a radial direction of the second diaphragm 22.

The surrounding member 3 surrounds the counterweight member 1 and the air space 4, and interconnects the first diaphragm 21 and the second diaphragm 22. Specifically, the surrounding member 3 interconnects outer peripheries of the surrounds 212, 222 of the first diaphragm 21 and the second diaphragm 22. A width of the surrounding member 3 in the first direction (V) is equal to that of the counterweight member 1. The first diaphragm 21 and the second diaphragm 22 are airtightly connected to the counterweight member 1 and the surrounding member 3, and are prevented from being in contact with each other by the counterweight member 1 and the surrounding member 3.

In order for the passive diaphragm assembly 100 to be adapted in a loudspeaker (not shown), it is required to be disposed on a housing member (not shown) that is disposed with a main driver (not shown). The passive diaphragm assembly 100 is adapted to cooperate with the main driver and the housing member to define an internal space thereamong. When the main driver generates sound waves, increases and decreases in air pressure in the internal space are generated, and air in the internal space is driven by the sound waves to push the passive diaphragm assembly 100. Therefore, the passive diaphragm assembly 100 vibrates. To provide a better audio performance, the passive diaphragm assembly 100 is required to vibrate in the first direction (V). However, the air may not only push the passive diaphragm assembly 100 in the first direction (V). For example, the air may also push the passive diaphragm assembly 100 in a second direction (S) (see FIG. 2). When the passive diaphragm assembly 100 is pushed in both the first direction (V) and the second direction (S), the central areas 211, 221 of the first diaphragm 21 and the second diaphragm 22 may tend to move in a third direction (T). However, the surrounds 212, 222 of the first diaphragm 21 and the second diaphragm 22 refrain the central areas 211, 221 from moving in the third direction (T). Specifically, even though the central areas 211, 221 are pushed in the second direction (S) by the air, the central areas 211, 221 are held by the surrounds 212, 222 so that the central areas 211, 221 may not move in the second direction (S). Furthermore, the presence of the grooves 212*a*, 222*a* of the first diaphragm 21 and the second diaphragm 22, and the air space 4 may reduce influence of the air pressure in the second direction (S). Therefore, the central areas 211, 221 may only move in the first direction (V), and so may the counterweight member 1. Consequently, the passive diaphragm assembly 100 may only move in the first direction (V). In comparison with a conventional passive radiator (not shown) having only one thin surround (i.e., one thin diaphragm), the passive diaphragm assembly 100 is less influenced by the air pressure that acts in the second direction (S).

It is noted that, in some embodiments (not shown), each of the first diaphragm 21 and the second diaphragm 22 is annular and has an inner edge. That is to say, the central area 211, 221 of each of the first diaphragm 21 and the second diaphragm 22 may be omitted. The counterweight member 1 interconnects the inner edges of the first diaphragm 21 and the second diaphragm 22. With the surrounds 212, 222 of the first diaphragm 21 and the second diaphragm 22, the inner edges of the first diaphragm 21 and the second diaphragm 22 are also refrained from moving in a direction that is different from the first direction (V), and so is the counterweight member 1. Therefore, in an embodiment in which the central areas 211, 221 are omitted, the passive diaphragm assembly 100 may vibrate only in the first direction (V) as well.

It is also noted that, in some embodiments (not shown), the surrounding member 3 may be omitted. That is to say, the first diaphragm 21 and the second diaphragm 22 are adapted to be directly connected to the housing member of the loudspeaker. Specifically, the housing member interconnects the outer peripheries of the surrounds 212, 222 of the first diaphragm 21 and the second diaphragm 22.

In summary, by virtue of the air space 4, and the first diaphragm 21 and the second diaphragm 22 that respectively have the surrounds 212, 222, and by virtue of the first diaphragm 21 and the second diaphragm 22 indented with grooves 212*a*, 222*a*, the passive diaphragm assembly 100 may be less influenced by the air pressure that acts in the second direction (S) and may only vibrate in the first direction (V). Therefore, the passive diaphragm assembly 100 may provide not only relatively high sound quality but also a relatively good audio performance.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A passive diaphragm assembly comprising:

a counterweight member; and a first diaphragm and a second diaphragm that are spaced apart from each other, that are connected respectively to opposite ends of said counterweight member, and that cooperate with said counterweight member to define an air space thereamong, wherein a surface of one of said first diaphragm and said second diaphragm which is opposite to the other one of said first diaphragm and said second diaphragm is indented with at least one groove; and wherein a surface of the other one of said first diaphragm and said second diaphragm which confronts said one of said first diaphragm and said second diaphragm is indented with at least one groove communicating with said air space.

2. The passive diaphragm assembly as claimed in claim 1, further comprising a surrounding member that surrounds said counterweight member and said air space, and that interconnects said first diaphragm and said second diaphragm.

3. The passive diaphragm assembly as claimed in claim 2, wherein said first diaphragm and said second diaphragm are prevented from being in contact with each other by said counterweight member and said surrounding member.

4. The passive diaphragm assembly as claimed in claim 2, wherein said first diaphragm and said second diaphragm are airtightly connected to said counterweight member and surrounding member.

5. The passive diaphragm assembly as claimed in claim 1, wherein each of said first diaphragm and said second diaphragm is annular and has an inner edge, said counterweight member interconnecting said inner edges of said first diaphragm and said second diaphragm.

6. The passive diaphragm assembly as claimed in claim 1, wherein each of said first diaphragm and said second diaphragm has a central area, said counterweight member being clamped between said central areas of said first diaphragm and said second diaphragm.

7. The passive diaphragm assembly as claimed in claim 6, wherein each of said first diaphragm and said second diaphragm is circular plate-shaped.

8. The passive diaphragm assembly as claimed in claim 1, wherein:

said at least one groove of the one of said first diaphragm and said second diaphragm includes a plurality of grooves angularly spaced apart from each other; and said at least one groove of the other one of said first diaphragm and said second diaphragm includes a plurality of grooves angularly spaced apart from each other.

9. The passive diaphragm assembly as claimed in claim 8, wherein:

each of said grooves of said first diaphragm extends in a direction different from a radial direction of said first diaphragm; and each of said grooves of said second diaphragm extends in a direction different from a radial direction of said second diaphragm.

10. The passive diaphragm assembly as claimed in claim 1, wherein each of said first diaphragm and said second diaphragm has an arc-shaped cross section, the cross section of said second diaphragm curving in a same direction as that of said first diaphragm.

11. The passive diaphragm assembly as claimed in claim 1, wherein each of said first diaphragm and said second diaphragm has a central area that is connected to said counterweight, and a surround that extends outwardly from said central area.

12. The passive diaphragm assembly as claimed in claim 11, wherein said surround of each of said first diaphragm and said second diaphragm has an arc-shaped cross section, the cross section of said surround of said second diaphragm curving in a same direction as the cross section of said surround of said first diaphragm being curved.

13. The passive diaphragm assembly as claimed in claim 1, wherein each of said first diaphragm and said second diaphragm is made of polyetheretherketone and is formed by a thermoforming process.

14. A passive diaphragm assembly comprising:

a counterweight member; and a first diaphragm and a second diaphragm that are spaced apart from each other, that are connected respectively to opposite ends of said counterweight member, and that cooperate with said counterweight member to define an air space thereamong, wherein each of said first diaphragm and said second diaphragm has a central area that is connected to said counterweight, and a surround that extends outwardly from said central area, wherein said surround of each of said first diaphragm and said second diaphragm has an arc-shaped cross section, the cross section of said surround of said second diaphragm curving in a same direction as the cross section of said surround of said first diaphragm being curved, and wherein said surround of each of said first diaphragm and said second diaphragm is indented with at least one groove that opens in a same direction in which the cross section of said surround of said first diaphragm curves.

15. The passive diaphragm assembly as claimed in claim 14, wherein:

said at least one groove of each of said first diaphragm and said second diaphragm includes a plurality of grooves;

said grooves of said first diaphragm are angularly spaced apart from each other; and said grooves of said second diaphragm are angularly spaced apart from each other.

16. The passive diaphragm assembly as claimed in claim 15, wherein:

each of said grooves of said first diaphragm extends in a direction different from a radial direction of said first diaphragm; and each of said grooves of said second diaphragm extends in a direction different from a radial direction of said second diaphragm.

* * * * *